US010823385B1

(12) United States Patent
Huang et al.

(10) Patent No.: US 10,823,385 B1
(45) Date of Patent: Nov. 3, 2020

(54) FRAME LAMP

(71) Applicant: XIAMEN ECO LIGHTING CO. LTD., Xiamen (CN)

(72) Inventors: Huiyon Huang, Xiamen (CN); Yongzhe Dong, Xiamen (CN); Xiaoliang Wen, Xiamen (CN); Shouqiang Hou, Xiamen (CN); Qiao rong Chen, Xiamen (CN)

(73) Assignee: XIAMEN ECO LIGHTING CO. LTD., Xiamen (CN)

( * ) Notice: Subject to any disclaimer, the term of this patent is extended or adjusted under 35 U.S.C. 154(b) by 0 days.

(21) Appl. No.: 16/543,505

(22) Filed: Aug. 16, 2019

(51) Int. Cl.

| | |
|---|---|
| ***F21V 23/00*** | (2015.01) |
| ***F21V 23/04*** | (2006.01) |
| ***F21V 23/06*** | (2006.01) |
| ***F21V 3/06*** | (2018.01) |
| ***F21V 17/00*** | (2006.01) |
| ***F21V 3/02*** | (2006.01) |
| *F21W 121/00* | (2006.01) |

(52) U.S. Cl.
CPC ..... *F21V 23/0471* (2013.01); *F21V 3/02* (2013.01); *F21V 3/062* (2018.02); *F21V 17/002* (2013.01); *F21V 23/005* (2013.01); *F21V 23/06* (2013.01); *F21W 2121/00* (2013.01)

(58) Field of Classification Search
CPC ..... F21V 23/0471; F21V 3/062; F21V 3/02; F21V 17/002; F21V 23/005; F21V 23/06; F21V 23/04; F21V 19/0005; F21V 23/0442; F21V 19/045; F21K 9/237; F21K 9/275; F21W 2121/00; F21W 2131/00
See application file for complete search history.

(56) References Cited

U.S. PATENT DOCUMENTS

2003/0185019 A1* 10/2003 Rogers ..... A63C 17/0093 362/545
2007/0183144 A1* 8/2007 Van Ulmer ..... F21S 8/028 362/647
2015/0294603 A1* 10/2015 Braunstein ..... G09F 13/22 40/544
2017/0370535 A1* 12/2017 Wu ..... F21V 23/04

FOREIGN PATENT DOCUMENTS

GB 2097110 A * 10/1982 ..... F21S 8/035

* cited by examiner

*Primary Examiner* — Y M. Quach Lee
(74) *Attorney, Agent, or Firm* — Chun-Ming Shih; Lanway IPR Services

(57) ABSTRACT

A frame lamp includes a bottom casing, a top casing, an illuminating component and a plug. The bottom casing has a plate form and has a cavity disposed therein. The top casing detachably engages with the bottom casing. The top casing includes a frame-shaped light transmitting component and a transparent decoration plate. The frame-shaped light transmitting component forms a window in its middle. The transparent decoration plate fits the window. The illuminating component is disposed within the cavity. The window allows light emission from the illuminating component within an emission area defined by the window. The plug extends across the bottom casing. Also, the plug is electrically coupled to the illuminating component. In addition, the plug relays power to the illuminating component while being electrically coupled to an external power source.

19 Claims, 3 Drawing Sheets

FRAME LAMP

BACKGROUND OF THE INVENTION

1. Field of the Invention

The present invention relates to a frame lamp, and more particularly, to a frame lamp having a small volume and a simple structure.

2. Description of the Prior Art

A conventional edge-lit lamp has a complicated structure for meeting various functional requirements. However, such complexity in structure leads to a higher fabrication cost and a lower error-tolerance rate. In addition, such conventional edge-lit lamp may still be limited by its luminance adjusting capability. That is, such conventional edge-lit lamp only provides a switch-on function and a switch-off function without giving any flexibility in dynamic adjustment of luminance. Also, because of the abovementioned complexity, the conventional edge-lit lamp inevitably occupies a large volume and is difficult to be designed in a portable manner.

SUMMARY OF THE INVENTION

The present invention aims at providing a frame lamp having a small volume, flexibility in adjusting luminance, and portability.

In one embodiment, the present invention discloses a frame lamp. The frame lamp includes a bottom casing, a top casing, an illuminating component and a plug. The bottom casing has a plate form and has a cavity disposed therein. The top casing detachably engages with the bottom casing. The top casing includes a frame-shaped light transmitting component and a transparent decoration plate. The frame-shaped light transmitting component forms a window in its middle. The transparent decoration plate fits the window. The illuminating component is disposed within the cavity. The window allows light emission from the illuminating component within an emission area defined by the window. The plug extends across the bottom casing. Also, the plug is electrically coupled to the illuminating component. In addition, the plug relays power to the illuminating component while being electrically coupled to an external power source.

In one example, the illuminating component includes a light source, a proximity sensor and a control circuit board. The light source emits lights of the illuminating component. The proximity sensor senses an object's proximity to the proximity sensor. The control circuit board is electrically coupled to the light source and the proximity sensor. Also, the control circuit board powers up the light source and adjusts an amplitude of the lights emitted by the light source according to the object's proximity to the proximity sensor.

In one example, the control circuit board increases the amplitude of the lights emitted by the light source when the object's proximity to the proximity sensor increases. The control circuit board further decreases the amplitude of the lights emitted by the light source when the object's proximity the proximity sensor decreases.

In one example, the control circuit board further switches on the light source when the object's proximity to the proximity sensor is within a critical distance from the proximity sensor. The control circuit board further switches off the light source when the object's proximity the proximity sensor is outside a critical distance from the proximity sensor.

In one example, the light source is disposed within the cavity in a way that the window is capable of relaying the lights emitted from the light source to the emission area.

In one example, the window, the frame-shaped light transmitting component, and an opening of the cavity share a same geometric shape. The frame-shaped light transmitting component fits the opening of the cavity.

In one example, the geometric shape is a rectangle.

In one example, the frame-shaped light transmitting component detachably engages with the transparent decoration plate.

In one example, the frame-shaped light transmitting component and the transparent decoration plate further detachably engages with each other via a snap fit, a threaded fit, an interference fit, a tongue-and-groove fit, a post-and-bore fit, or a press fit.

In one example, the frame-shaped light transmitting component further detachably engages with the bottom casing.

In one example, the frame-shaped light transmitting component and the bottom casing further detachably engage with each other via a snap fit, a threaded fit, an interference fit, a tongue-and-groove fit, a post-and-bore fit, or a press fit.

In one example, the frame-shaped light transmitting component includes a first engaging element. The bottom casing further includes a second engaging element disposed at an opening of the cavity. The first engaging element is detachably engaged with the second engaging element. Such that the frame-shaped light transmitting component is detachably engaged with the bottom casing.

In one example, the first engaging element and the second engaging element further detachably engage with each other via a snap fit, a threaded fit, an interference fit, a tongue-and-groove fit, a post-and-bore fit, or a press fit.

In one example, the frame lamp further includes a screw. The bottom casing further includes a hollow pillar standing within the cavity. The illuminating component includes a control circuit board, which includes a through hole. The screw pivots through the through hole and enters a receiving hole of the hollow pillar. Such that the screw detachably engages the circuit board to the bottom casing.

In one example, the frame lamp further includes a switch. The switch is disposed on a lateral side of the bottom casing. Also, the switch is electrically coupled to the illuminating component. In addition, the switch switches on or switches off the illuminating component according to a command received by the switch.

In one example, the switch comprises a toggle switch or a stepless switch.

In one example, the frame lamp further includes a regulator. The regulator is electrically coupled to the switch. Also, the regulator is disposed on and electrically coupled to a control circuit board of the illuminating component. Furthermore, the regulator controls luminance of the illuminating component according to the command.

In one example, the plug is integrated to the bottom casing by plastic molding.

In one example, the frame-shaped light transmitting component is made of opal optical polycarbonate (PC) or opal polystyrene (PS).

In one example, the transparent decoration plate comprises a poly(methyl methacrylate) (PMMA) plate, a polycarbonate (PC) plate, a silk screen dot printing plate, or a laser dot plate.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
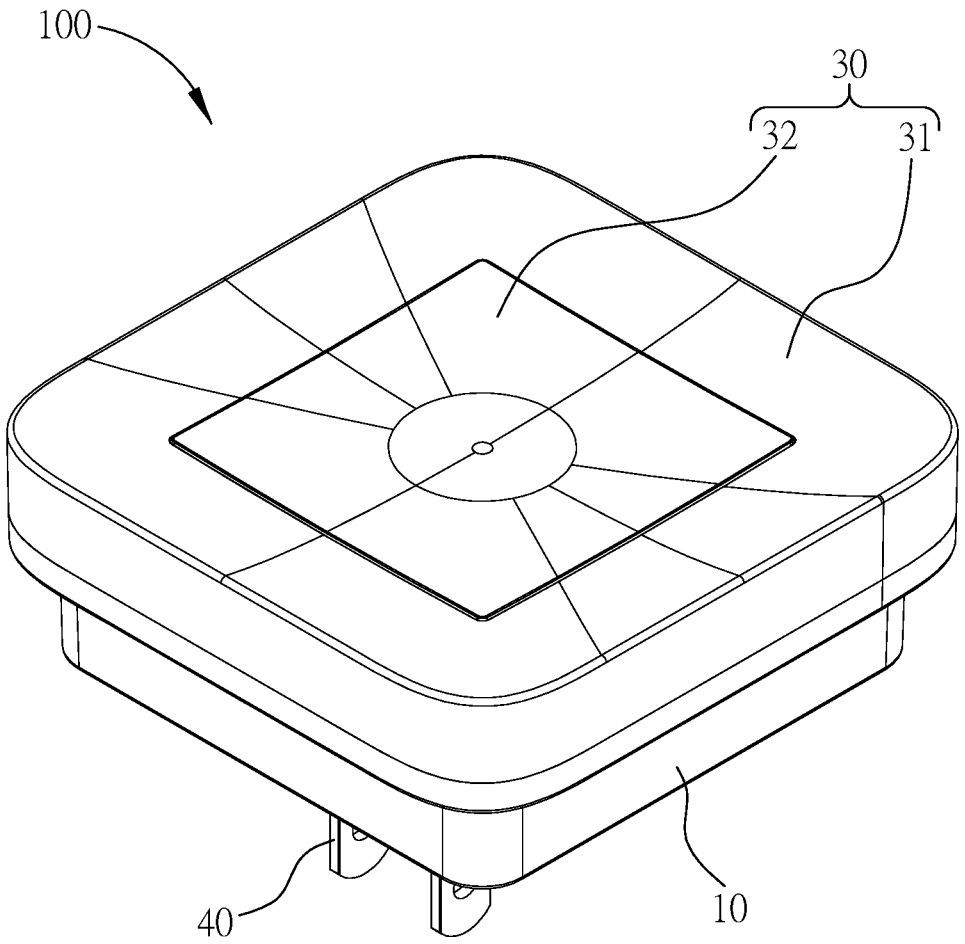
FIG. 1 illustrates a topside view of a frame lamp according to one embodiment of the present invention.
Figure 2:
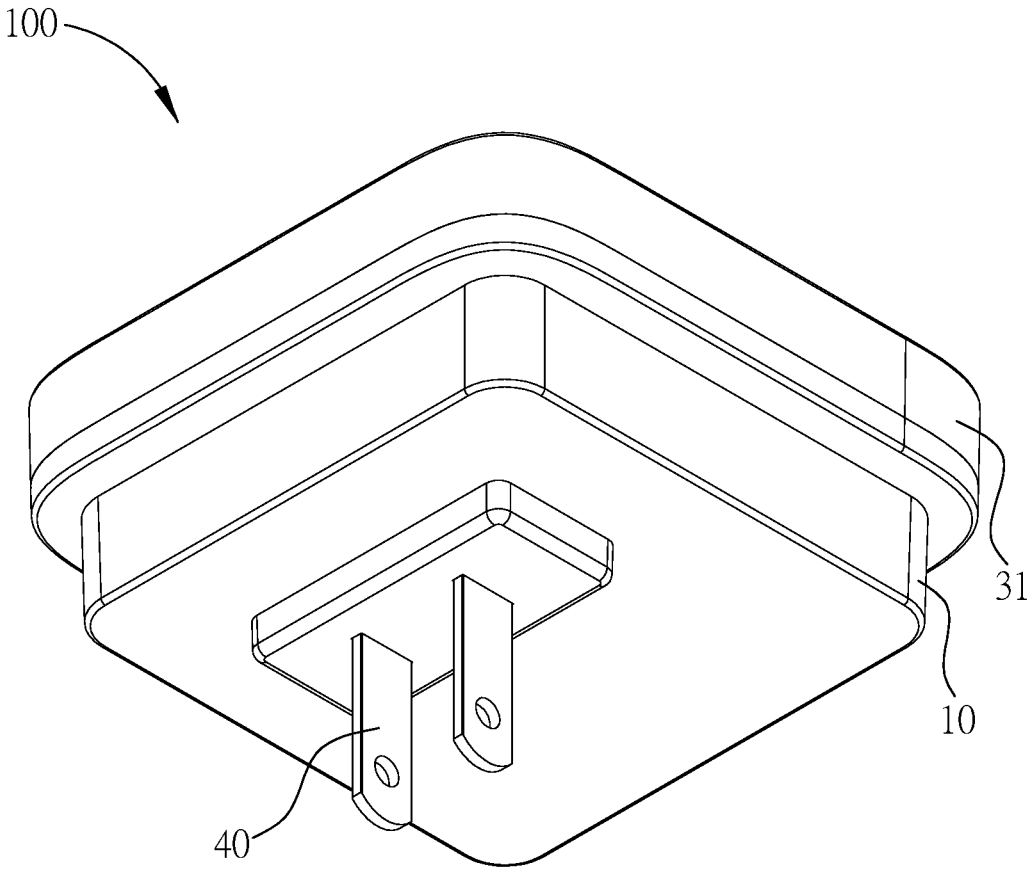
FIG. 2 illustrates a backside view of the frame lamp according to one embodiment of the present invention.
Figure 3:
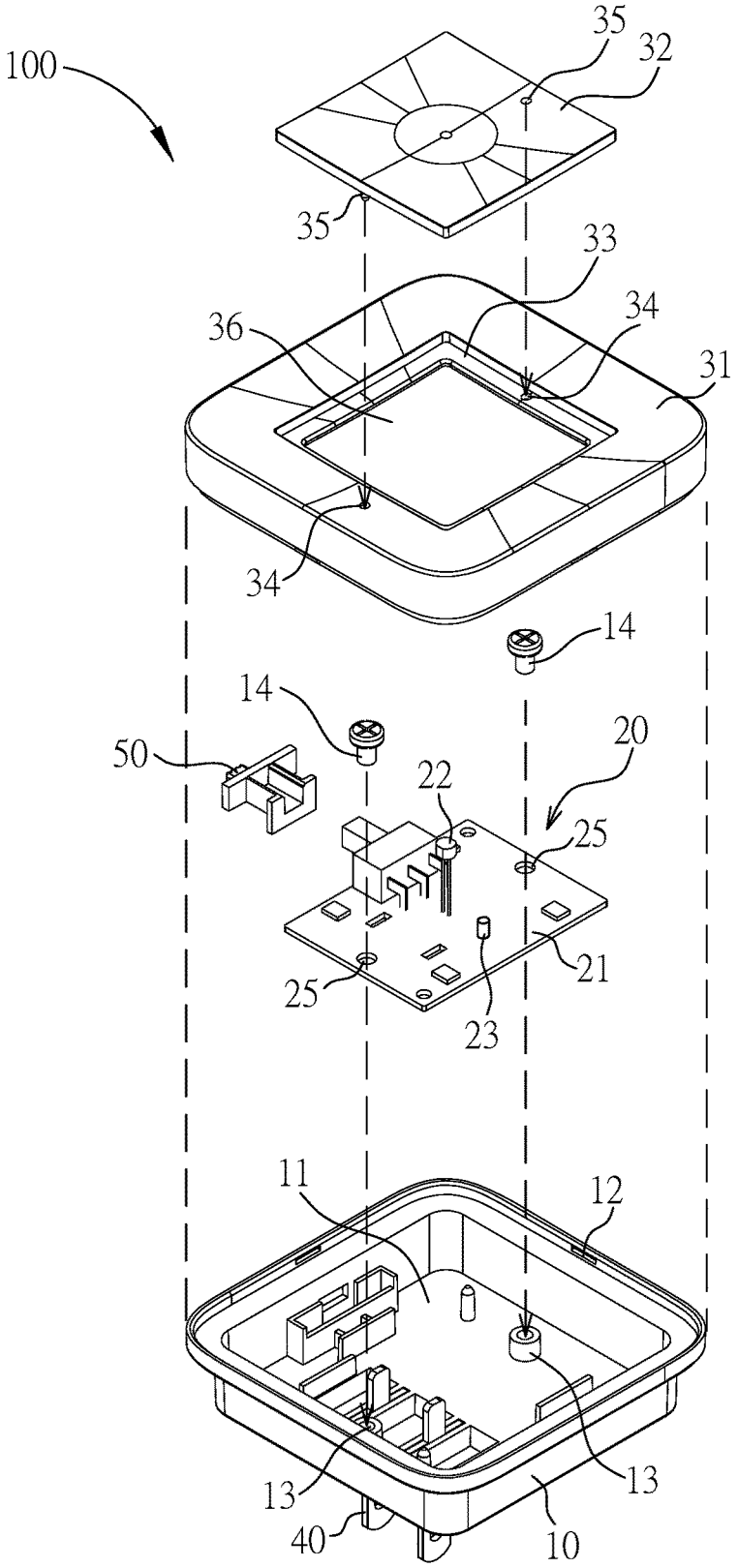
FIG. 3 illustrates an exploded view of the frame lamp according to one embodiment of the present invention.

As mentioned above, the present invention discloses a frame lamp for overcoming defects of a conventional edge-lit lamp. Please refer to FIGS. 1-3, which illustrate a frame lamp 100 according to one embodiment of the present invention. More particularly, FIG. 1 illustrates a topside view of the frame lamp 100. FIG. 2 illustrates a backside view of the frame lamp 100. And FIG. 3 illustrates an exploded view of the frame lamp 100.

In one embodiment, the frame lamp 100 includes a bottom casing 10, a top casing 30, an illuminating component 20 and a plug 40.

The bottom casing 10 has a cavity 11 disposed inside itself. The top casing 30 includes a frame-shaped light transmitting component 31 and a transparent decoration plate 32. The frame-shaped light transmitting component 31 forms a window 36 in its middle. The transparent decoration plate 32 is designed for fitting and covering the window 36.

The illuminating component 20 is disposed within the cavity 11. The window 36 allows light emission from the illuminating component 20 within an emission area defined by the window 36. It is noted that the transparent decoration plate 32 does not block most of the light emission from the illuminating component 20 because of its transparency. The plug 40 extends across the bottom casing 10. Also, the plug 40 is electrically coupled to the illuminating component 20. In addition, when the plug 40 is electrically coupled to an external power source, the plug 40 is capable of relaying power to the illuminating component 20.

Specifically, because of the frame shape of the top casing 30 and a plate form of the bottom casing 10, and because the illuminating component 20 is capable of fitting the cavity 11 without protruding out of the window 36 by design, the frame lamp 100 may have a significantly small volume and a simple internal structure, and moreover, a lighter weight, better portability, and easy assembling.

In addition, since the illuminating component 20 is disposed within the cavity 11, lights emitted from the illuminating component 20 can be focused on the emission area defined by the window 36 in a more distributed manner, such that the emission area may give a smoother vision to anyone who uses the frame lamp 100.

In one example, the illuminating component 20 includes a light source 22, a proximity sensor 23, and a control circuit board 21. The light source 22 emits lights of the illuminating component 20. The proximity sensor 23 senses an object's proximity to itself, including an approaching human user. The control circuit board 21 is electrically coupled to the light source 22 and the proximity sensor 23. Also, the control circuit board 21 powers up the light source 22. In addition, the control circuit board 21 adjusts an amplitude of the lights emitted by the light source 22 according to the object's proximity to the proximity sensor 23. More specifically, in one example, when the object's proximity to the proximity sensor 23 increases, the control circuit board 21 increases the amplitude of the lights emitted by the light source 22 in response. Similarly, in one example, when the object's proximity to the proximity sensor 23 decreases, the control circuit board 21 decreases the amplitude of the lights emitted by the light source 22 in response. In this way, the frame lamp 100 can have dynamic and efficient power consumption, e.g., no additional wasted power is caused when a user is far away from the frame lamp 100.

In still another example, when the object's proximity to the proximity sensor 23 is within a critical distance from the proximity sensor 23, the control circuit board 21 switches on the light source 22. Also, in one example, when the object's proximity to the proximity sensor 23 is outside a critical distance from the proximity sensor 23, the control circuit board 21 switches off the light source 22. In this way, the frame lamp 100 will have no wasted power consumption when a user is away from the frame lamp 100.

In one example, the light source 22 is disposed within the cavity 11 in a way that the window 36 is capable of relaying the lights emitted from the light source 22 to the emission area. Therefore, lights emitted from the illuminating component 20 can be better focused and be presented in a more uniformly distributed manner.

In one example, the window 36, the frame-shaped light transmitting component 31, and an opening of the cavity 11 share a same geometric shape. Also, the frame-shaped light transmitting component 31 is designed to fit the opening of the cavity 11. In one example, the geometric shape is rectangle.

In one example, the frame-shaped light transmitting component 31 is detachably engaged with the transparent decoration plate 32. Such that the frame lamp 100 can be easily shifted from place to place with the aid of easy assembling and better portability. In some examples, the frame-shaped light transmitting component 31 is detachably engaged with the transparent decoration plate 32 via a snap fit, a threaded fit, an interference fit, a tongue-and-groove fit, a post-and-bore fit, or a press fit.

In one example, the frame-shaped light transmitting component 31 includes at least one first engaging element, e.g., at least one receiving hole 34. Also, the bottom casing 10 includes at least one second engaging element disposed at the opening of the cavity 11, e.g., at least one pillar 35. In addition, the at least one receiving hole 34 is capable of respectively and detachably engaged with the at least one pillar 35, such that the frame-shaped light transmitting component 31 is detachably engaged with the transparent decoration plate 32. In some example, the at least one first engaging element is detachably engaged with the at least one second engaging element via a snap fit, a threaded fit, an interference fit, a tongue-and-groove fit, a post-and-bore fit, or a press fit, for the purpose of detachably engaging the frame-shaped light transmitting component 31 with the transparent decoration plate 32.

In one example, the frame-shaped light transmitting component 20 is detachably engaged with the bottom casing 10. It helps the portability and easy assembling of the frame lamp 100 too. In some examples, the frame-shaped light transmitting component 20 is detachably engaged with the bottom casing 10 via a snap fit, a threaded fit, an interference fit, a tongue-and-groove fit, a post-and-bore fit, or a press fit.

In one example, the frame lamp 100 includes at least one screw 14. Also, the bottom casing 10 includes at least one hollow pillar 13 that stands within the cavity 11. On top of that, the control circuit board 21 includes at least one through hole 25. The at least one screw 14, the at least one hollow pillar 13 and the at least one through hole 25 share a same amount. Each of the at least one screw 14 pivots through a corresponding through hole 25 and in turn enters a receiving hole of a corresponding hollow pillar 13. In this way, the screw 14 detachably engages the control circuit board 21 to the bottom casing 10.

In one example, the frame lamp 100 includes a switch 50, that is disposed on a lateral side of the bottom casing 10. Also, the switch 50 is electrically coupled to the illuminating component 20. Moreover, the switch 50 switches on or switches off the illuminating component according to a command received by the switch 50, for example, a manual command that manipulates the switch 50. In some examples, the switch 50 is a toggle switch or a stepless switch. In another example, the frame lamp 100 includes a regulator (not shown for brevity) that is disposed on the control circuit board 21. The regulator is electrically coupled to the switch 50 for manual operation. The regulator is also electrically coupled to the control circuit board 21 for adjusting luminance of the light source 22. More specifically, the regulator controls luminance of the illuminating component 20 according to a command issued on the switch 50, for example, a manual command issued by flipping or pressing the switch 50. In this way, there is flexibility of a use in adjusting the illuminating component 20's luminance manually.

In one example, the plug 40 is integrated to the bottom casing 10 by plastic molding. Such that the plug 40 acquires a stronger connection with the bottom casing 10. The plug 40 also thereby prevents itself from falling off the bottom casing 10 easily.

In one example, the frame-shaped light transmitting component 31 is made of opal optical polycarbonate (PC) or opal polystyrene (PS).

In one example, the transparent decoration plate 32 may be a poly(methyl methacrylate) (PMMA) plate, a polycarbonate (PC) plate, a silk screen dot printing plate, or a laser dot plate.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A frame lamp, comprising:

a bottom casing, having a plate form and having a cavity disposed therein;

a top casing, configured to detachably engage with the bottom casing, wherein the top casing comprises:

a frame-shaped light transmitting component, in the middle of which a window is formed; and a transparent decoration plate, configured to fit the window;

an illuminating component, disposed within the cavity, wherein the window is configured to allow light emission from the illuminating component within an emission area defined by the window and to allow sensing an object's proximity via the window; and a plug, configured to extend across the bottom casing, electrically coupled to the illuminating component, and configured to relay power to the illuminating component while being electrically coupled to an external power source by plugging the plug into the external power source, wherein the illuminating component comprises:

a light source, configured to emit lights of the illuminating component;

a proximity sensor, configured to sense an object's proximity to the proximity sensor; and a control circuit board, electrically coupled to the light source and the proximity sensor, and configured to power up the light source and adjust an amplitude of the lights emitted by the light source according to the object's proximity to the proximity sensor.

2. The frame lamp of claim 1, wherein the control circuit board is further configured to increase the amplitude of the lights emitted by the light source when the object's proximity to the proximity sensor increases; and wherein the control circuit board is further configured to decrease the amplitude of the lights emitted by the light source when the object's proximity to the proximity sensor decreases.

3. The frame lamp of claim 1, wherein the control circuit board is further configured to switch on the light source when the object's proximity to the proximity sensor is within a critical distance from the proximity sensor; and wherein the control circuit board is further configured to switch off the light source when the object's proximity to the proximity sensor is outside a critical distance from the proximity sensor.

4. The frame lamp of claim 1, wherein the light source is disposed within the cavity in a way that the window is capable of relaying the lights emitted from the light source to the emission area.

5. The frame lamp of claim 1, wherein the window, the frame-shaped light transmitting component, and an opening of the cavity share a same geometric shape; and wherein the frame-shaped light transmitting component is configured to fit the opening of the cavity.

6. The frame lamp of claim 5, wherein the geometric shape is a rectangle.

7. The frame lamp of claim 1, wherein the frame-shaped light transmitting component is configured to detachably engaged with the transparent decoration plate.

8. The frame lamp of claim 7, wherein the frame-shaped light transmitting component and the transparent decoration plate are further configured to detachably engage with each other via a snap fit, a threaded fit, an interference fit, a tongue-and-groove fit, a post-and-bore fit, or a press fit.

9. The frame lamp of claim 1, wherein the frame-shaped light transmitting component is further configured to detachably engage with the bottom casing.

10. The frame lamp of claim 9, wherein the frame-shaped light transmitting component and the bottom casing are further configured to detachably engage with each other via a snap fit, a threaded fit, an interference fit, a tongue-and-groove fit, a post-and-bore fit, or a press fit.

11. The frame lamp of claim 9, wherein the frame-shaped light transmitting component comprises a first engaging element;

wherein the bottom casing further comprises a second engaging element disposed at an opening of the cavity; and wherein the first engaging element is configured to detachably engaged with the second engaging element, such that the frame-shaped light transmitting component is detachably engaged with the bottom casing.

12. The frame lamp of claim 11, wherein the first engaging element and the second engaging element are further configured to detachably engage with each other via a snap fit, a threaded fit, an interference fit, a tongue-and-groove fit, a post-and-bore fit, or a press fit.

13. The frame lamp of claim 1, further comprising a screw;

wherein the bottom casing further comprising a hollow pillar standing within the cavity;

wherein the illuminating component comprises a control circuit board that comprises a through hole; and wherein the screw is configured to pivot through the through hole and to enter a receiving hole of the hollow pillar, such that the screw detachably engages the control circuit board to the bottom casing.

14. The frame lamp of claim 1, further comprising:

a switch, disposed on a lateral side of the bottom casing, electrically coupled to the illuminating component, and configured to switch on or switch off the illuminating component according to a command received by the switch.

15. The frame lamp of claim 14, wherein the switch comprises a toggle switch or a stepless switch.

16. The frame lamp of claim 14, further comprising:

a regulator, electrically coupled to the switch, disposed on and electrically coupled to a control circuit board of the illuminating component, and configured to control luminance of the illuminating component according to the command.

17. The frame lamp of claim 1, wherein the plug is integrated to the bottom casing by plastic molding.

18. The frame lamp of claim 1, wherein the frame-shaped light transmitting component is made of opal optical polycarbonate (PC) or opal polystyrene (PS).

19. The frame lamp of claim 1, wherein the transparent decoration plate comprises a poly(methyl methacrylate) (PMMA) plate, a polycarbonate (PC) plate, a silk screen dot printing plate, or a laser dot plate.

* * * * *